US008994288B2

(12) United States Patent
Moskowitz

(10) Patent No.: US 8,994,288 B2
(45) Date of Patent: Mar. 31, 2015

(54) PULSE-EXCITED MERCURY-FREE LAMP SYSTEM

(71) Applicant: Philip E. Moskowitz, Georgetown, MA (US)

(72) Inventor: Philip E. Moskowitz, Georgetown, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 193 days.

(21) Appl. No.: 13/788,611

(22) Filed: Mar. 7, 2013

(65) Prior Publication Data

US 2014/0252979 A1 Sep. 11, 2014

(51) Int. Cl.
*H05B 41/30* (2006.01)
*H05B 41/288* (2006.01)

(52) U.S. Cl.
CPC ..... *H05B 41/288* (2013.01); *Y10S 315/07* (2013.01)
USPC ..... 315/245; 315/209 R; 315/291; 315/326; 315/359; 315/DIG. 7; 313/484; 313/485; 313/567; 313/637; 313/643

(58) Field of Classification Search
USPC ..... 315/209 R, 224–226, 246, 247, 291, 315/307, 308, 326, 358, DIG. 7; 313/484, 313/485, 567, 571, 634, 637, 638, 643
See application file for complete search history.

(56) References Cited

U.S. PATENT DOCUMENTS 4,092,565 A 5/1978 Neal
4,464,606 A 8/1984 Kane
4,540,917 A 9/1985 Luchaco et al.
4,665,341 A 5/1987 Imamura et al.
5,523,655 A * 6/1996 Jennato et al. ..... 315/246
5,631,523 A 5/1997 Rothenbuhler et al.
5,866,984 A * 2/1999 Doughty et al. ..... 313/643
5,959,405 A 9/1999 Soules et al.

(Continued)

FOREIGN PATENT DOCUMENTS

EP 0586180 A1 3/1994
EP 0320974 B1 3/1995

(Continued)

OTHER PUBLICATIONS

Christopher Smith, International Search Report and Written Opinion of the International Searching Authority for PCT/US2012/036890, Jul. 25, 2012, pp. 1-11, European Patent Office, Rijswijk, The Netherlands.

*Primary Examiner* — Douglas W Owens
*Assistant Examiner* — Thai Pham
(74) *Attorney, Agent, or Firm* — Shaun P. Montana

(57) ABSTRACT

A pulse-excited mercury-free lamp system, and method of sustaining the emission of light emission from such a lamp, is provided. The system includes a light-transmissive envelope having an inner surface and a phosphor layer coated thereon. A discharge-sustaining gaseous mixture of a noble gas, at a low pressure, and a metal halide, is retained inside the light-transmissive envelope. An electrical system provides a plurality of pulses to the discharge-sustaining gaseous mixture, resulting in a discharge, which causes the lamp system to emit light. The emission of light is maintained by turning the discharge on during a pulse width of each pulse in the plurality of pulses and by turning the discharge off during a remainder of each period in the plurality of pulses. Particularly in systems where the metal halide is indium-based, this maintains an efficient emission of light without the use of mercury.

20 Claims, 3 Drawing Sheets

(56) References Cited

U.S. PATENT DOCUMENTS

| | | | | |
|---|---|---|---|---|
| 6,972,521 | B2 | 12/2005 | Scholl et al. | |
| 2003/0076020 | A1 | 4/2003 | Anami et al. | |
| 2003/0209970 | A1 | 11/2003 | Bader et al. | |
| 2006/0071584 | A1 | 4/2006 | Kurachi et al. | |
| 2006/0108945 | A1 | 5/2006 | Chandler et al. | |
| 2006/0132043 | A1* | 6/2006 | Srivastava et al. | 313/638 |
| 2009/0273267 | A1 | 11/2009 | Stockwald et al. | |
| 2013/0307432 | A1* | 11/2013 | Lv et al. | 315/210 |

FOREIGN PATENT DOCUMENTS

| | | | |
|---|---|---|---|
| EP | 0548342 | B1 | 4/1997 |
| JP | 54 054473 | A | 4/1979 |

* cited by examiner

PULSE-EXCITED MERCURY-FREE LAMP SYSTEM

TECHNICAL FIELD

The present invention relates to lighting, and more specifically, to mercury-free gas discharge lamps.

BACKGROUND

Typical gas discharge lamps include a small amount of mercury, which is used to excite the discharge that results in the lamp producing light. While mercury performs this function very well, the potential damage to the natural environment and to people that may be caused by mercury is now very well known. Thus, reducing and/or removing mercury from lighting has long been a desired goal.

One alternative to using mercury to excite a discharge is to use a low pressure indium chloride discharge instead of mercury. Under certain conditions, such as the discharge current, the temperature of the indium chloride concentrate, the temperature of the bulb wall, and the type and pressure of the fill gas within the lamp, an indium chloride discharge can effectively replace mercury within a low pressure discharge lamp, with minimal or no loss in lamp efficacy.

SUMMARY

Conventional techniques for replacing mercury in a low pressure gas discharge lamp with an indium chloride, or other type of metal halide, discharge suffer from a variety of issues. Most importantly, under certain conditions, the indium chloride experiences species segregation in the positive column. That is, if a cylindrical, extended positive column gas discharge filled with indium chloride and a noble gas is burned horizontally, the typical position for a low pressure gas discharge lamp, the desired indium emission slowly decreases in power, when the input power is fixed. The indium and indium chloride emission move upwards towards the top of the tube, reducing the efficiency of the discharge and thus of the lamp, by virtue of the reduced volume of excited gas and changed plasma conditions near the wall.

Embodiments as described herein overcome this limitation by providing a pulsed excitation, instead of a fixed sinusoidal excitation. In other words, a highly modulated periodic waveform that turns the discharge off for a period of time, and then back on, does not result in the reduced efficiency described above. Rather, in embodiments as described herein, by turning the discharge on and then off and then back on, etc., when turned back on, the indium and indium chloride emissions return to previous peak levels instead of decaying, and are spatially centered in the lamp instead of migrating to the top of the lamp. As described herein in greater detail, the time for which the discharge is turned off, i.e., the time between pulses or, equivalently, the remainder of each period, is short enough such that there is no visual manifestation of the lack of emission. Alternatively, or additionally, the remainder of each period may be defined as a time less than the ambipolar diffusion time, which will depend on the size of the lamp and the pressure of the rare fill gas (e.g., argon, krypton, neon, xenon, etc.), as well as potentially other conditions. For example, for a lamp having a diameter of approximately 2.5 centimeters and using argon as the fill gas at a pressure of approximately 133 Pascal, the remainder of each period needed to maintain the discharge at desirable stability and efficient for operation in place of a typical mercury-based low pressure discharge lamp would be approximately one millisecond. If the pulses are too close together, that is if the frequency decreases to the point where the pulses in essence disappear (i.e., steady state), then the discharge will dissipate after a time, depending on the operating conditions, and the lamp will cease to provide light.

In an embodiment, there is provided a gas discharge lamp system. The gas discharge lamp system includes: a light-transmissive envelope having an inner surface and a phosphor layer coated thereon; a discharge-sustaining gaseous mixture retained inside the light-transmissive envelope, the discharge-sustaining gaseous mixture comprising a noble gas, at a low pressure, and a metal halide; and an electrical system configured to provide a plurality of pulses to the discharge-sustaining gaseous mixture, wherein the plurality of pulses has a period, wherein each pulse in the plurality of pulses has a pulse width less than the period, wherein the plurality of pulses results in a discharge within the light-transmissive envelope turning on during the pulse width of each pulse in the plurality of pulses and turning off during a remainder of each period in the plurality of pulses, causing the lamp system to emit light.

In a related embodiment, the remainder of each period of the plurality of pulses may be less than an ambipolar diffusion time of the discharge. In another related embodiment, the period of the plurality of pulses may be at least substantially one millisecond greater than the pulse width. In yet another related embodiment, the noble gas may include argon, at substantially 133 Pascal. In still another related embodiment, the metal halide may include an indium halide. In a further related embodiment, the indium halide may include indium chloride. In another further related embodiment, the indium halide may include substantially one milligram indium chloride.

In yet still another related embodiment, the noble gas may include argon, the metal halide may include indium chloride, and the discharge-sustaining gaseous mixture may further include indium. In still yet another related embodiment, the metal halide may include one of gallium, tin, and zirconium.

In yet still another related embodiment, the gas discharge lamp system may further include a controller coupled to the electrical system, wherein the controller may be configured to modify the pulse width and/or the period so as to maintain the discharge as a substantially optimized discharge within the light-transmissive envelope. In still yet another related embodiment, the electrical system may include an electrical element and a pulse modulation generator, the pulse modulation generator may generate the plurality of pulses and the plurality of pulses may be provided to the discharge-sustaining gaseous mixture via the electrical element. In a further related embodiment, the electrical element may include an electrode within the light-transmissive envelope. In another further related embodiment, the electrical element may include an electrodeless coupler external to the light-transmissive envelope.

In still another related embodiment, the light-transmissive envelope may be oriented in a substantially horizontal direction.

In another embodiment, there is provided a method of sustaining an emission of light from a mercury-free lamp. The method includes: dispensing a discharge-sustaining gaseous mixture inside a light-transmissive envelope, the discharge-sustaining gaseous mixture comprising a noble gas, at a low pressure, and a metal halide; connecting an electrical system to the light transmissive envelope; providing a plurality of pulses, via the electrical system, to the discharge-sustaining gaseous mixture within the light-transmissive envelope, resulting in a discharge within the light-transmissive envelope; producing an emission of light from the mercury-free lamp; and sustaining the emission of light by turning the discharge on during a pulse width of each pulse in the plurality of pulses and by turning the discharge off during a remainder of each period in the plurality of pulses.

In a related embodiment, dispensing may include dispensing a discharge-sustaining gaseous mixture inside a light-transmissive envelope, the discharge-sustaining gaseous mixture comprising argon, at a low pressure, and an indium halide. In another related embodiment, dispensing may include dispensing a discharge-sustaining gaseous mixture inside a light-transmissive envelope, the discharge-sustaining gaseous mixture comprising argon, at a low pressure, and indium chloride. In still another related embodiment, dispensing may include dispensing a discharge-sustaining gaseous mixture inside a light-transmissive envelope, the discharge-sustaining gaseous mixture comprising a noble gas, at a low pressure, and one of gallium, tin, and zirconium.

In yet another related embodiment, sustaining may include sustaining the emission of light by turning the discharge on during a pulse width of each pulse in the plurality of pulses and by turning the discharge off during a remainder of each period in the plurality of pulses, wherein a period of the plurality of pulses may be at least substantially one millisecond longer than the pulse width of a pulse in the plurality of pulses. In still yet another related embodiment, sustaining may include sustaining the emission of light by turning the discharge on during a pulse width of each pulse in the plurality of pulses and by turning the discharge off during a remainder of each period in the plurality of pulses, wherein the remainder of each period of the plurality of pulses may be less than an ambipolar diffusion time of the discharge.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
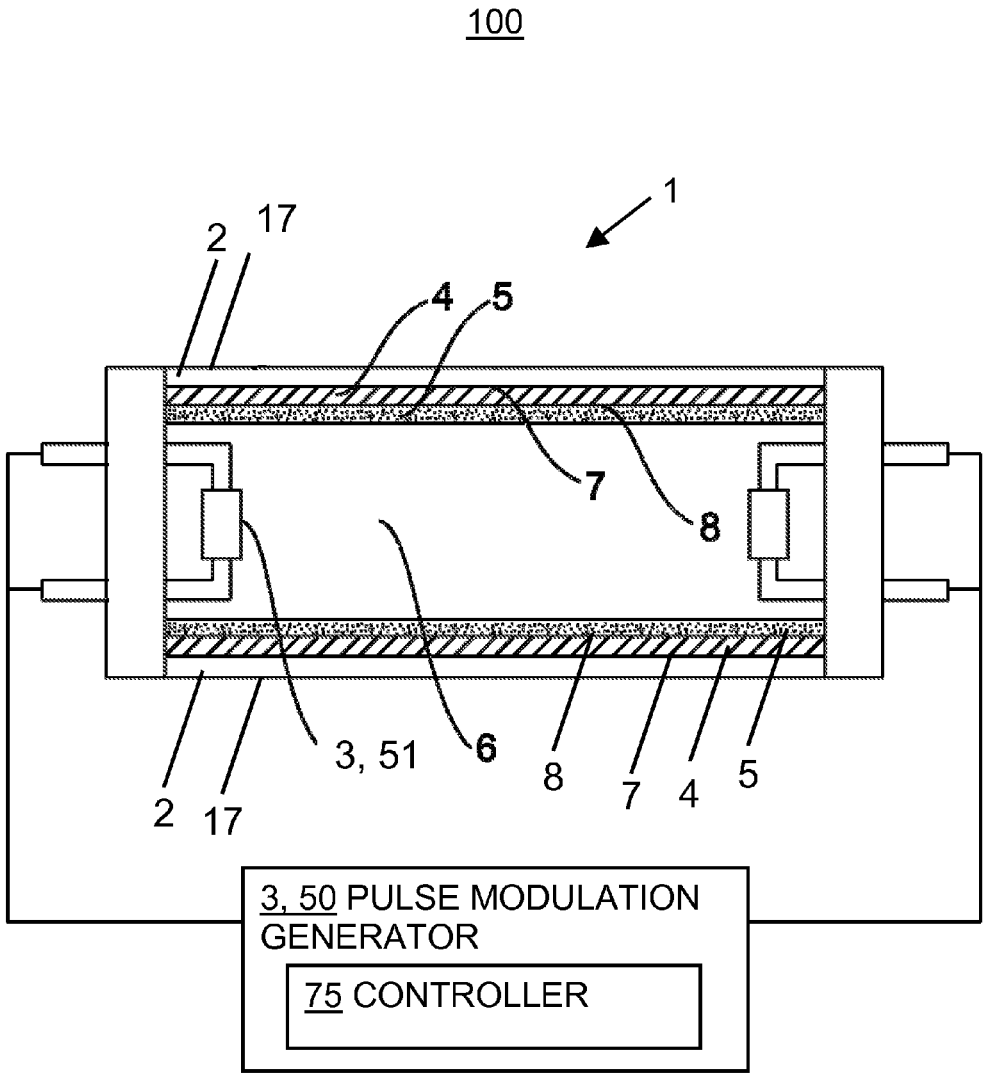
FIG. 1 shows a cross-sectional view of a mercury-free gas discharge lamp system according to embodiments disclosed herein.
Figure 2:
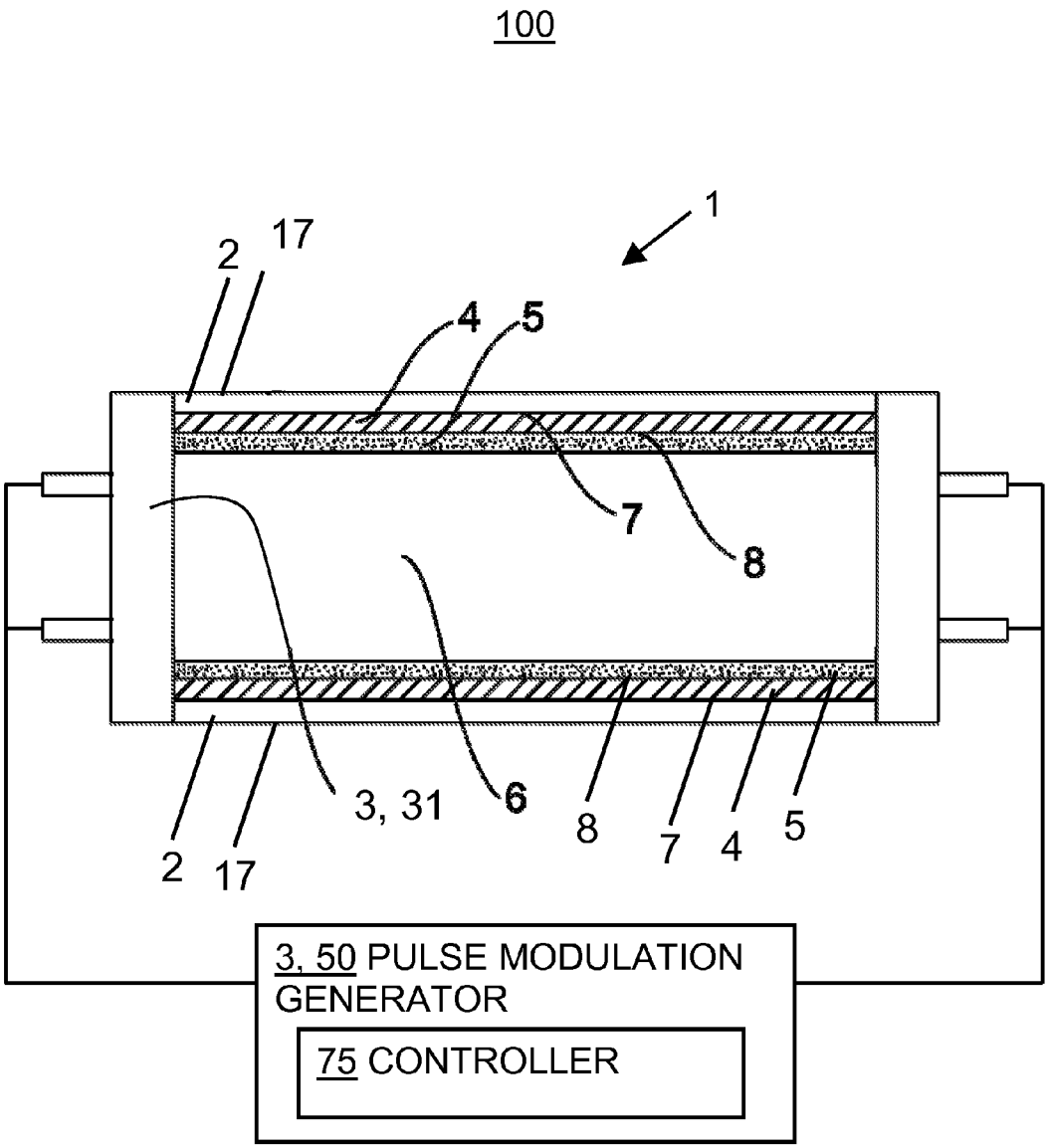
FIG. 2 shows a cross-sectional view of a mercury-free gas discharge lamp system according to embodiments disclosed herein.

A mercury-free low pressure gas discharge lamp 1, as a part of a system 100, is shown in a cross-sectional view in FIG. 1 and includes a light-transmissive envelope 2 and an electrical system 3. The electrical system 3, in some embodiments, includes a pulse modulation generator 50 and an electrical element. In some embodiments, such as shown in FIG. 1, the electrical element is an electrode 51 within the light-transmissive envelope 2, though in other embodiments, such as shown in FIG. 2, the electrical element is an electrodeless coupler 31 (for example but not limited to a magnetic inductive coupler, a capacitive coupler, and/or any other known type of coupler) that is external to the light-transmissive envelope 2. The electrical system 3 provides a plurality of pulses within the light-transmissive envelope 2, as is described in greater detail below, to cause the mercury-free low pressure gas discharge lamp 1 to emit light. Some embodiments include more than one electrical element 51, 31. In embodiments where there is a plurality of electrical elements, the plurality of electrical elements may be arranged on one end or the other end of the light-transmissive envelope 2, either inside or outside. Alternatively, or additionally, the plurality of electrical elements may be arranged on opposing ends of the light-transmissive envelope 2, either inside or outside.

The light-transmissive envelope 2 is made from any material that is capable of containing the components of the mercury-free low pressure gas discharge lamp 1, as described herein, and that is capable of transmitting light. In some embodiments, the light-transmissive envelope 2 is made from glass. Alternatively, or additionally, in some embodiments the light-transmissive envelope 2 is made from a composite of materials including glass. The light-transmissive envelope 2 includes an inner surface 7 and an outer surface 17. The outer surface 17 of the light-transmissive envelope 2 is visible when looking at the lamp 1. In some embodiments, the outer surface 17 of the light-transmissive envelope 2 includes a protective coating that prevents spreading of the material and/or materials comprising the outer surface 17, should the outer surface 17 break. The inner surface 7 of the light-transmissive envelope 2 contains a light scattering reflective layer 4, which in some embodiments additionally serves as a barrier and is formed from, for example, fumed alumina. Fumed alumina has a high ultraviolet (UV) light reflectance and good visible light transmittance. Of course, any known light scattering reflective material may be used, regardless of its UV light reflectance properties. In some embodiments, the light scattering reflective layer 4 is disposed on the entire inner surface 7 of the light-transmissive envelope 2. Alternatively, in other embodiments, the light scattering reflective layer 4 is disposed on a portion of the inner surface 7 of the light-transmissive envelope 2. In some embodiments, the light-transmissive envelope 2 includes a heat reflecting coating, such as but not limited to indium-tin-oxide (ITO), to maintain the temperature required for the discharge within the lamp 1.

In addition to the light scattering reflective layer 4, a phosphor layer 5 is also coated on the inner surface 7 of the light-transmissive envelope 2. In some embodiments, the phosphor layer 5 is coated on an inner surface 8 of the light scattering reflective layer 4. The phosphor layer 5 serves to achieve a variety of spectral power distributions and colors for the light emitted by the mercury-free low pressure gas discharge lamp 1. In some embodiments, the phosphor layer 5 is coated on the entire inner surface 8 of the light scattering reflective layer 4. Alternatively, in other embodiments, the phosphor layer 5 is coated on a portion of the inner surface 8 of the light scattering reflective layer 4. The light scattering reflective layer 4 reflects any UV light not initially captured by the phosphor layer 5 back into the phosphor layer 5, thereby maximizing the effectiveness of the phosphor layer 5. As stated above, the light scattering reflective layer 4 may also serve as a barrier layer so as to prevent migration of materials inside the mercury-free gas discharge lamp 1 into the material of the light-transmissive envelope 2 during usage. By preventing such migration, graying and lowered efficiency of the material of the light-transmissive envelope 2 are reduced, and service life and efficiency are increased.

A discharge-sustaining gaseous mixture 6 is also supplied inside of the light-transmissive envelope 2. The discharge-sustaining gaseous mixture 6 is at a low pressure, and is comprised of at least one noble gas and a metal halide. The discharge-sustaining gaseous mixture 6 is retained within the interior of the light-transmissive envelope 2. In some embodiments, the discharge-sustaining gaseous mixture 6 contains argon, at a low pressure, such as but not limited to 133 Pascal and/or substantially 133 Pascal. Of course, other noble gases such as helium, neon, krypton, and xenon may be, and in some embodiments are, used. In some embodiments, a combination of two or more noble gases is used. In some embodiments, the metal halide is an indium halide, and in some embodiments, the indium halide is indium chloride. In some embodiments, the amount of indium chloride present in the discharge-sustaining gaseous mixture 6 is substantially one milligram. In some embodiments, in addition to an indium halide, the discharge-sustaining gaseous mixture also includes indium, in some embodiments, substantially one milligram of indium. Though embodiments are described primarily with reference to indium halide, of course other metal halides, such as but not limited to gallium, tin, and/or zirconium, and/or combinations thereof, may be, and in some embodiments are, used without departing from the scope of the invention. As is known in the art, the discharge-sustaining gaseous mixture 6 is at a conventional fill temperature appropriate for operation of the mercury-free gas discharge lamp 1.

As briefly discussed above, the electrical system 3 causes a discharge within the light-transmissive envelope 2 that results in the mercury-free gas discharge lamp 1 emitting light. More specifically, the electrical system 3 provides a plurality of pulses within the light-transmissive envelope 2 that excites the discharge-sustaining gaseous mixture 6, creating a discharge. In embodiments where the electrical system 3 includes a pulse modulation generator 50, the pulse modulation generator 50 provides the plurality of pulses to the discharge-sustaining gaseous mixture 6 via the electrical element (for example but not limited to the electrode 51 shown in FIG. 1 or the electrodeless coupler 31 shown in FIG. 2). The plurality of pulses may take any known shape, and includes but is not limited to a continuous square wave. In such embodiments, the pulse modulation generator 50 includes a square wave generator. The plurality of pulses has a period, measured in a unit of time. During each period of the plurality of pulses, there is a first segment of time (also referred to herein as a pulse width) in which the pulse is provided to the discharge-sustaining gaseous mixture 6, resulting in a discharge within the lamp 1. Thus, during the pulse width, the discharge may be said to have be turned on. There is then a second segment of time in which no pulse is provided, and there is no discharge within the lamp 1. During this second segment of time, which is also referred to as a remainder of the period, the discharge may be said to have been turned off. The pulse width of each pulse is less than the period. The remainder of the period is, in some embodiments, less than the ambipolar diffusion time of the discharge. Such pulsed excitation of the discharge-sustaining gaseous mixture 6, which includes an indium halide or other metal halide, sustains the emission of light from the mercury-free gas discharge lamp 1, particularly when the light-transmissive envelope 2 is in a horizontal and/or substantially horizontal position. The indium halide and/or other metal halide remains in a central portion of the mercury-free gas discharge lamp 1, instead of migrating towards the inner surface 7 of the light-transmissive envelope 3. This results in a sustained and efficient emission of light from the mercury-free gas discharge lamp 1, particularly when the mercury-free gas discharge lamp 1 is installed horizontally and/or substantially horizontally. In some embodiments, the period of the plurality of pulses is one millisecond, and/or substantially one millisecond, longer than a pulse width. Thus, the discharge-sustaining gaseous mixture 6 is excited for the pulse width, and then not excited for one millisecond and/or substantially one millisecond, and then excited for the pulse width, etc. In some embodiments, the period of the plurality of pulses is at least one millisecond, and/or substantially one millisecond, longer than a pulse width. For example, in some embodiments, the pulse width is ten milliseconds and/or substantially ten milliseconds, and the period is thirteen point three milliseconds and/or substantially thirteen point three milliseconds. This results in, for each pulse in the plurality of pulses, the discharge-sustaining gaseous mixture 6 being excited (i.e., having a discharge) for ten milliseconds and/or substantially ten milliseconds, and then undergoing no excitation (i.e., having no discharge) for three point three milliseconds and/or substantially three point three milliseconds, in repetition as long as the plurality of pulses is provided to the mercury-free gas discharge lamp 1 by the electrical system 3.

In some embodiments, the electrical system 3, and more particularly the pulse modulation generator 50, is controlled by a controller 75. The controller 75 is, in some embodiments, coupled to the pulse modulation generator 50, and in some embodiments, is part of the pulse modulation generator 50. The controller 75 is configured to modify the pulse width and/or the period so as to maintain a substantially optimized discharge within the light-transmissive envelope 2. Differing pulse widths and/or periods of the plurality of pulses may be needed depending on the metal halide present in the discharge-sustaining gaseous mixture 6, the operating time and/or age of the mercury-free gas discharge lamp 1, the noble gas and/or gases used, as well as other factors.

Figure 3:
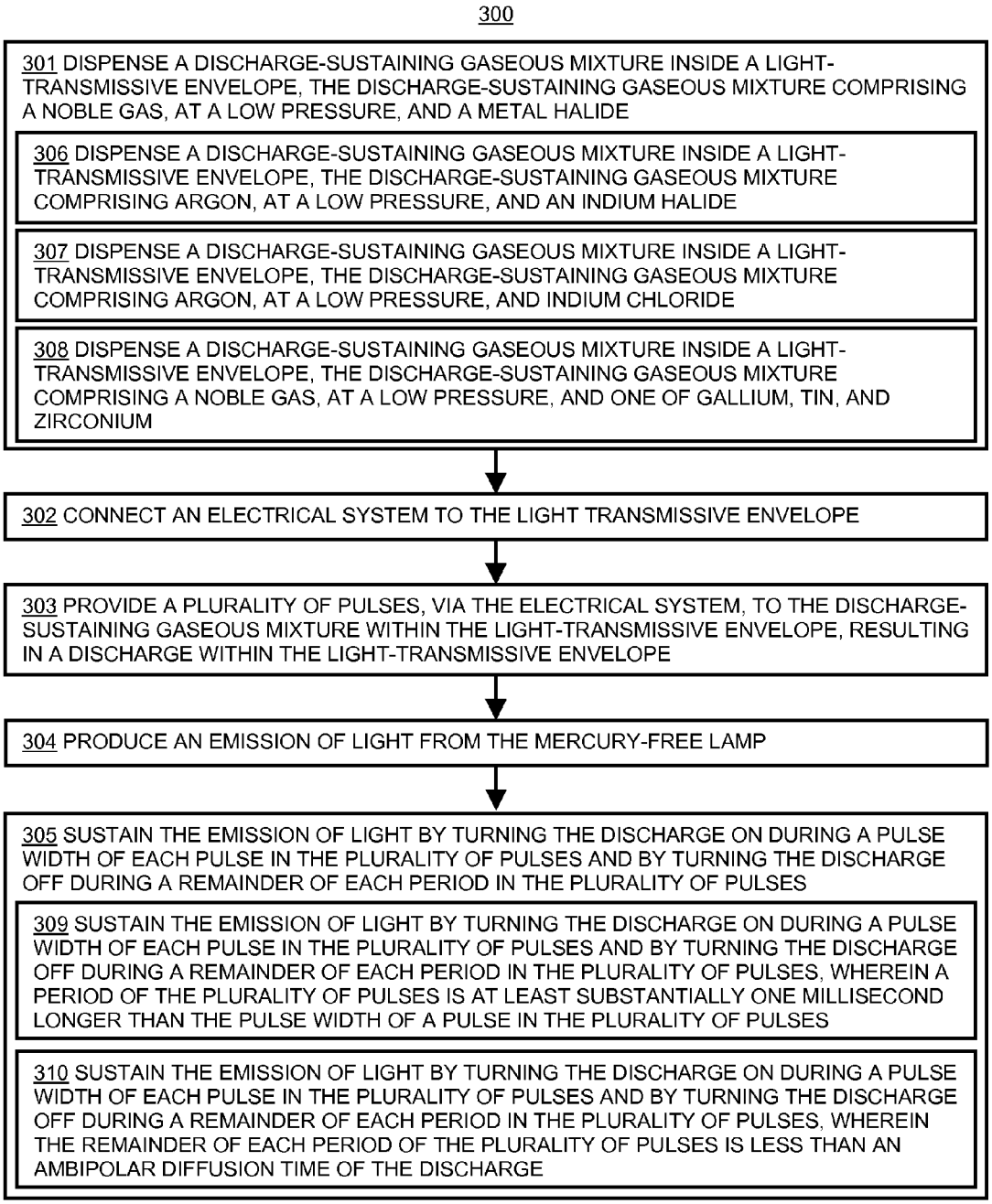
FIG. 3 shows a method of maintaining emission of light from a mercury-free gas discharge lamp according to embodiments disclosed herein.

FIG. 3 shows a method 300 of sustaining an emission of light from a mercury-free lamp, such as but not limited to the mercury-free gas discharge lamp 1 shown in FIGS. 1 and 2. A discharge-sustaining gaseous mixture, such as but not limited to the discharge-sustaining gaseous mixture 6 described throughout, is dispensed inside a light-transmissive envelope, such as but not limited to the light-transmissive envelope 2 shown in FIGS. 1 and 2, step 301. The discharge-sustaining gaseous mixture includes a noble gas, at a low pressure, and a metal halide. In some embodiments, a discharge-sustaining gaseous mixture comprising argon, at a low pressure, and an indium halide, is dispensed inside the light-transmissive envelope, step 306. In some embodiments, a discharge-sustaining gaseous mixture comprising argon, at a low pressure, and indium chloride, is dispensed inside the light-transmissive envelope, step 307. In some embodiments, a discharge-sustaining gaseous mixture comprising a noble gas, at a low pressure, and one of gallium, tin, and zirconium, is dispensed inside the light-transmissive envelope, step 308. An electrical system, such as but not limited to the electrical system 3 described throughout in relation to FIGS. 1 and 2, is connected to the light transmissive envelope, step 302. A plurality of pluses is then provided, via the electrical system, to the discharge-sustaining gaseous mixture within the light-transmissive envelope, resulting in a discharge within the light-transmissive envelope, step 303. An emission of light from the mercury-free lamp is then produced, step 304. The emission of light is sustained by turning the discharge on during a pulse width of each pulse in the plurality of pulses and by turning the discharge off during a remainder of each period in the plurality of pulses, step 305. In some embodiments, the emission of light is sustained by turning the discharge on during a pulse width of each pulse in the plurality of pulses and by turning the discharge off during a remainder of each period in the plurality of pulses, wherein a period of the plurality of pulses is at least substantially one millisecond longer than the pulse width of a pulse in the plurality of pulses, step 309. In some embodiments, the emission of light is sustained by turning the discharge on during a pulse width of each pulse in the plurality of pulses and by turning the discharge off during a remainder of each period in the plurality of pulses, wherein a remainder of each period of the plurality of pulses is less than ambipolar diffusion time of the discharge, step 310.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A gas discharge lamp system, comprising:

a light-transmissive envelope having an inner surface and a phosphor layer coated thereon;

a discharge-sustaining gaseous mixture retained inside the light-transmissive envelope, the discharge-sustaining gaseous mixture comprising a noble gas, at a low pressure, and a metal halide; and an electrical system configured to provide a plurality of pulses to the discharge-sustaining gaseous mixture, wherein the plurality of pulses has a period, wherein each pulse in the plurality of pulses has a pulse width less than the period, wherein the plurality of pulses results in a discharge within the light-transmissive envelope turning on during the pulse width of each pulse in the plurality of pulses and turning off during a remainder of each period in the plurality of pulses, causing the lamp system to emit light.

2. The gas discharge lamp system of claim 1, wherein the remainder of each period of the plurality of pulses is less than an ambipolar diffusion time of the discharge.

3. The gas discharge lamp system of claim 1, wherein the period of the plurality of pulses is at least substantially one millisecond greater than the pulse width.

4. The gas discharge lamp system of claim 1, wherein the noble gas comprises argon, at substantially 133 Pascal.

5. The gas discharge lamp system of claim 4, wherein the metal halide comprises an indium halide.

6. The gas discharge lamp system of claim 5, wherein the indium halide comprises indium chloride.

7. The gas discharge lamp system of claim 5, wherein the indium halide comprises substantially one milligram indium chloride.

8. The gas discharge lamp system of claim 1, wherein the noble gas comprises argon, wherein the metal halide comprises indium chloride, and wherein the discharge-sustaining gaseous mixture further comprises indium.

9. The gas discharge lamp system of claim 1, wherein the metal halide comprises one of gallium, tin, and zirconium.

10. The gas discharge lamp system of claim 1, further comprising:

a controller coupled to the electrical system, wherein the controller is configured to modify the pulse width and/or the period so as to maintain the discharge as a substantially optimized discharge within the light-transmissive envelope.

11. The gas discharge lamp system of claim 1, wherein the electrical system comprises an electrical element and a pulse modulation generator, wherein the pulse modulation generator generates the plurality of pulses and wherein the plurality of pulses is provided to the discharge-sustaining gaseous mixture via the electrical element.

12. The gas discharge lamp system of claim 11, wherein the electrical element comprises an electrode within the light-transmissive envelope.

13. The gas discharge lamp system of claim 11, wherein the electrical element comprises an electrodeless coupler external to the light-transmissive envelope.

14. The gas discharge lamp system of claim 1, wherein the light-transmissive envelope is oriented in a substantially horizontal direction.

15. A method of sustaining an emission of light from a mercury-free lamp, comprising:

dispensing a discharge-sustaining gaseous mixture inside a light-transmissive envelope, the discharge-sustaining gaseous mixture comprising a noble gas, at a low pressure, and a metal halide;

connecting an electrical system to the light transmissive envelope;

providing a plurality of pulses, via the electrical system, to the discharge-sustaining gaseous mixture within the light-transmissive envelope, resulting in a discharge within the light-transmissive envelope;

producing an emission of light from the mercury-free lamp; and sustaining the emission of light by turning the discharge on during a pulse width of each pulse in the plurality of pulses and by turning the discharge off during a remainder of each period in the plurality of pulses.

16. The method of claim 15, wherein dispensing comprises:

dispensing a discharge-sustaining gaseous mixture inside a light-transmissive envelope, the discharge-sustaining gaseous mixture comprising argon, at a low pressure, and an indium halide.

17. The method of claim 15, wherein dispensing comprises:

dispensing a discharge-sustaining gaseous mixture inside a light-transmissive envelope, the discharge-sustaining gaseous mixture comprising argon, at a low pressure, and indium chloride.

18. The method of claim 15, wherein dispensing comprises:

dispensing a discharge-sustaining gaseous mixture inside a light-transmissive envelope, the discharge-sustaining gaseous mixture comprising a noble gas, at a low pressure, and one of gallium, tin, and zirconium.

19. The method of claim 15, wherein sustaining comprises:

sustaining the emission of light by turning the discharge on during a pulse width of each pulse in the plurality of pulses and by turning the discharge off during a remainder of each period in the plurality of pulses, wherein a period of the plurality of pulses is at least substantially one millisecond longer than the pulse width of a pulse in the plurality of pulses.

20. The method of claim 15, wherein sustaining comprises: sustaining the emission of light by turning the discharge on during a pulse width of each pulse in the plurality of pulses and by turning the discharge off during a remainder of each period in the plurality of pulses, wherein the remainder of each period of the plurality of pulses is less than an ambipolar diffusion time of the discharge.

* * * * *